US011234523B2

(12) United States Patent
Sun

(10) Patent No.: US 11,234,523 B2
(45) Date of Patent: Feb. 1, 2022

(54) SWIVEL CHAIR PROVIDED WITH LENGTH-ADJUSTABLE LEG TUBES

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 16/852,400

(22) Filed: Apr. 17, 2020

(65) Prior Publication Data

US 2020/0329873 A1 Oct. 22, 2020

(30) Foreign Application Priority Data

Apr. 17, 2019 (CN) ..... 201920569842.7

(51) Int. Cl.
*A47C 4/22* (2006.01)
*A47C 7/34* (2006.01)
*A47C 3/18* (2006.01)

(52) U.S. Cl.
CPC ..... *A47C 4/22* (2013.01); *A47C 3/18* (2013.01); *A47C 7/34* (2013.01)

(58) Field of Classification Search
CPC .. A47C 3/18; A47C 7/407; A47C 3/40; A47C 4/20; A47C 4/286
See application file for complete search history.

(56) References Cited

U.S. PATENT DOCUMENTS 2,876,825 A * 3/1959 Boortz ..... A47C 4/20 108/132
5,364,163 A * 11/1994 Hardison ..... A47C 3/18 297/344.21
5,505,524 A * 4/1996 Drumwright ..... A47C 1/04 248/169
2009/0243346 A1* 10/2009 Chen ..... B63B 34/10 297/51

* cited by examiner

*Primary Examiner* — Sarah B Mcpartlin
(74) *Attorney, Agent, or Firm* — WPAT Law, P.C.; Anthony King

(57) ABSTRACT

A swivel chair provided with length-adjustable leg tubes, a chair frame assembly, a seat leg connection assembly, and a leg tube assembly rotatably connected with the chair frame assembly through the seat leg connection assembly, wherein the chair frame assembly includes a chair cloth, two turning bases, two turning base reinforcing pieces, and a back tube.

8 Claims, 5 Drawing Sheets

SWIVEL CHAIR PROVIDED WITH LENGTH-ADJUSTABLE LEG TUBES

BACKGROUND OF THE INVENTION

1. Technical Field

The invention relates to a swivel chair provided with length-adjustable leg tubes.

2. Description of Related Art

People are spending more and more time in leisure and entertainment, and at the same time, a portable swivel chair capable of being used both indoors and outdoors is desired to meet the leisure and entertainment requirements of people. However, existing swivel chairs are mostly used indoors.

BRIEF SUMMARY OF THE INVENTION

The technical issue to be settled by the invention is to overcome the limitation in application places of existing swivel chairs by providing a swivel chair which is provided with length-adjustable leg tubes and is suitable for outdoor recreational fishing as well as indoor relaxation after work.

The technical solution adopted by the invention to settle the technical issue is as follows.

The swivel chair provided with length-adjustable leg tubes includes a chair frame assembly, a seat leg connection assembly and a leg tube assembly. The chair frame assembly is rotatably connected with the leg tube assembly through the seat leg connection assembly and includes a chair cloth, two turning bases, two turning base reinforcing pieces, a back tube, a seat frame, and an upper connection plate. The back tube is perpendicular to the seat frame. The left end and the right end of the back tube can be turned forwards by 90° respectively through the two turning bases so as to be hinged to the seat frame. The upper connection plate is fixedly mounted at the bottom of the seat frame. The two turning base reinforcing pieces are respectively attached to the outer sides of the two turning bases and are connected with the back tube and the seat frame through rivets together with the turning bases. The back tube and the seat frame are sleeved with the chair cloth.

The leg tube assembly includes a bushing used for mounting the leg tube connection assembly, an upper leg tube fixing base, four upper leg tube connectors, two upper stretchable leg tubes, two lock mechanisms, two lower leg tubes, four universal leg pads, four tie rods, a tie rod base, a tie rod base fixing tube, and two upper necking leg tubes, wherein an annular flange is arranged at the upper end of the bushing and has an outer diameter slightly greater than an inner diameter of the upper leg tube fixing base, the bushing is inlaid in the tie rod base fixing tube from top to bottom and is integrally connected with the tie rod base fixing tube, the tie rod base fixing tube is disposed in the upper leg tube fixing base and is able to move upwards or downwards, and the lower end of the tie rod base fixing tube is fixedly mounted on the upper portion of the tie rod base; the two upper stretchable leg tubes are arranged adjacently, the two upper necking leg tubes are also arranged adjacently, the two upper stretchable leg tubes are bilaterally symmetrical with the two upper necking leg tubes, the lower ends of the upper necking leg tubes are necking ends, the upper ends of the two upper stretchable leg tubes and the upper ends of the two upper necking leg tubes are respectively arranged in the four upper leg tube connectors in a sleeved manner and are rotatably connected to the upper leg tube fixing base through rivets, the necking ends of the two upper necking leg tubes are connected with two universal leg pads, the lower ends of the two lower leg tubes are connected with the other two universal leg pads, the upper ends of the two lower leg tubes stretch into the lower ends of the two upper stretchable leg tubes and are able to stretch upwards or retract downwards through the two lock mechanisms, one ends of the four tie rods are hinged to the lower portion of the tie rod base, and the other ends of the four tie rods are hinged to the upper portions of the two upper stretchable leg tubes and the upper portions of the two upper necking leg tubes.

The back tube can be turned forwards to be folded through the turning bases, the two upper stretchable leg tubes and the two upper necking leg tubes are can be drawn inwards, and the lower leg tubes can stretch upwards or retract downwards in the upper stretchable leg tubes by locking or unlocking the lock mechanisms.

Furthermore, each lock mechanism includes a lock case, a lever, a limiting iron ring, a compression ring and a protective shell, wherein an opening is formed in the side face of the lower portion of the lock case, a limiting groove is formed in an inner wall, opposite to the opening, of the lock case, the top end of the opening in the lock case is higher than the limiting groove, a ring part of the limiting iron ring is located in the opening in the lock case and is clamped in the limiting groove, the compression spring is located below the limiting iron ring and has an upper end connected with a handle of the limiting iron ring and a lower end connected with the lock case, the protective shell is located outside the compression spring, and the lever is located above the limiting iron ring and is hinged to the protective shell and the lock case. The lower ends of the upper stretchable leg tubes stretch into the upper portions of the lock cases. The upper ends of the lower leg tubes sequentially penetrate through the lower portions of the lock cases and the ring parts of the limiting iron rings from bottom to top to stretch into the upper stretchable leg tubes. The inner diameter of the limiting iron rings is greater than the outer diameter of the lower leg tubes.

The lower ends of the levers are of an eccentric structure. When the levers are rotated downwards, the lower ends of the levers downward press the handles of the limiting iron rings to realize unlocking, and then the lower leg tubes can stretch upwards or retract downwards.

Furthermore, the seat leg connection assembly is a non-rocking seat leg connection assembly which includes a lower connection plate, a limiting buckle and a cylindrical mandrel, wherein the upper end of the cylindrical mandrel is fixed to the bottom of the lower connection plate, the cylindrical mandrel is rotatably assembled on the bushing, a folding edge capable of being folded upwards is arranged on the front side of the lower connection plate, sliding grooves are formed in the left side and the right side of the upper connection plate, a folding edge capable of being upwards is arranged in the middle of the front side of the upper connection plate, the limiting buckle is located on the right side of the upper connection plate and is hinged to the folding edge of the lower connection plate, and the lower connection plate is inserted into the sliding grooves in the left side and the right side of the upper connection plate; and the limiting buckle is rotated to be clamped on the folding edge of the upper connection plate, then the upper connection plate is prevented from disengaging from the sliding grooves, so that locking or unlocking is realized.

Furthermore, the seat leg connection assembly is a rocking seat leg connection assembly which includes two plate springs, a spring fixing plate and a cylindrical mandrel, wherein the spring fixing plate is in a T shape, the upper end of the cylindrical mandrel is fixed to a longitudinal portion of the T shape, and the two plate springs are arranged on the left side and the right side of the spring fixing plate in a bilaterally symmetrical manner; and each plate spring has a front end connected to a horizontal portion of the T shape and a rear end fixed to the upper connection plate through a bolt.

Furthermore, the seat frame includes a U-shaped circular tube which is open forwards and a plurality of U-shaped square tubes which are open upwards, each U-shaped square tube has two ends respectively fixed to the left side and the right side of the U-shaped circular tube, the bottoms of the U-shaped square tubes are located on the same plane, and upper connection plate is welded to the bottoms of the U-shaped square tubes.

The swivel chair of the invention has the beneficial effects of being foldable and suitable for outdoor recreational fishing as well as indoor relaxation after work.

DETAILED DESCRIPTION OF THE INVENTION

The invention is further described below with reference to the accompanying drawings.

Referring to FIGS. 1-9, a swivel chair provided with length-adjustable leg tubes includes a chair frame assembly A, a seat leg connection assembly B and a leg tube assembly C.

Figure 1:
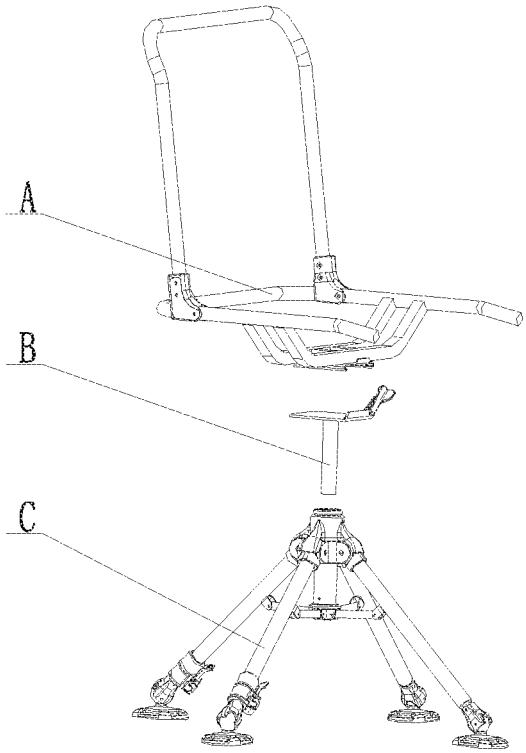
FIG. 1 is an unfolded view of the invention.
Figure 2:
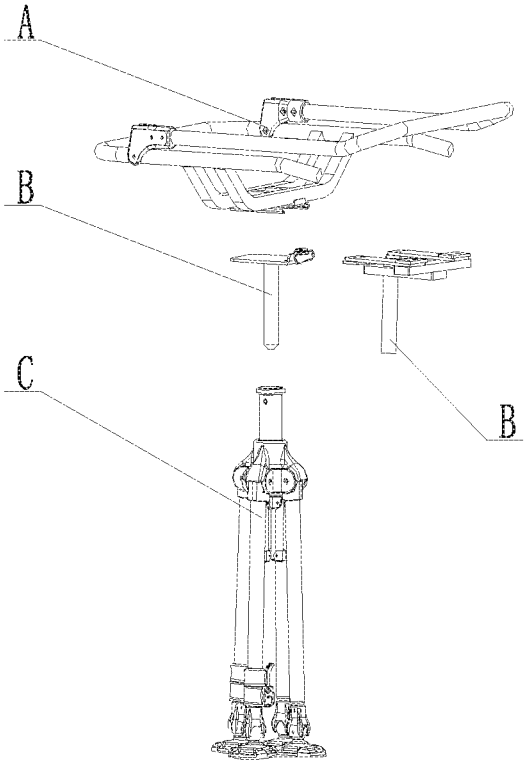
FIG. 2 is a folded view of the invention.
Figure 3:
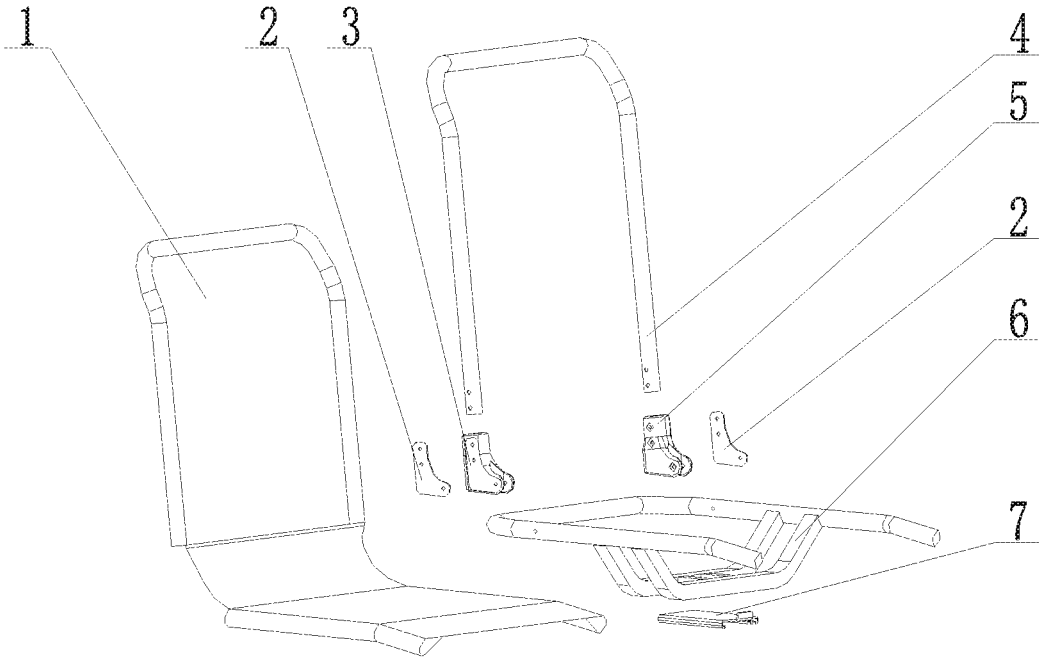
FIG. 3 is an exploded view of a chair frame assembly.

As shown in FIG. 3, the chair frame assembly A includes a chair cloth 1, a right turning base 3, a back tube 4, a left turning base 5, two turning base reinforcing pieces 2, a seat frame 6 and an upper connection plate 7, wherein the right end of the back tube 4 is inserted into the right turning base 3 and is connected with the right turning base 3 through a rivet after one turning base reinforcing piece 2 is attached to the exterior of the right turning base 3, and the left end of the back tube 4 is inserted into the left turning base 5 and is connected with the left turning base 5 through a rivet after the other turning base reinforcing piece 2 is attached to the exterior of the left turning base 5. After the back tube 4 is riveted on the right turning base 3 and the left turning base 5, the right turning base 3 and the left turning base 5 are erected on a U-shaped circular tube of the seat frame 6 and are connected to the U-shaped circular tube of the seat frame 6 through rivets around which the right turning base 3 and the left turning base 5 are able to rotate to withdraw or stretch the back tube 4. The upper connection plate 7 is connected to lower planes of square tubes of the seat frame 6 through welding. The back tube 4 and the U-shaped circular tube of the seat frame 6 are sleeved with the chair cloth 1. Sliding grooves are formed in the left side and the right side of the upper connection plate, and a folding edge capable of being folded upwards is arranged in the middle of the front side of the upper connection plate.

Figure 4:
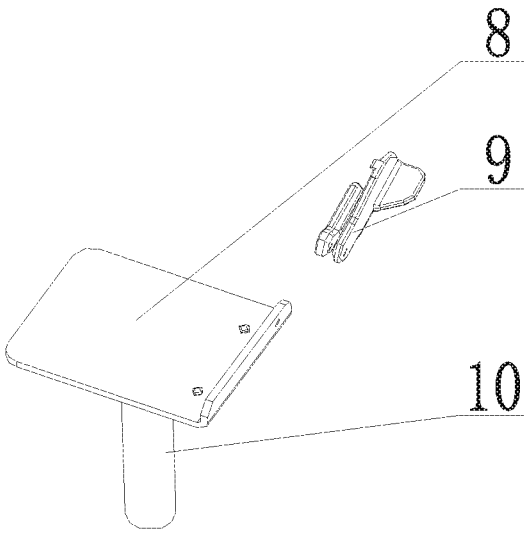
FIG. 4 is an exploded view of a non-rocking seat leg connection assembly.
Figure 5:
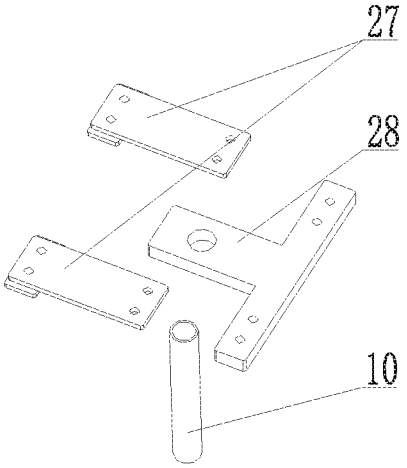
FIG. 5 is an exploded view of a rocking seat leg connection assembly.

The seat leg connection assembly B is a non-rocking seat leg connection assembly (shown in FIG. 4) or a rocking seat leg connection assembly (shown in FIG. 5).

As shown in FIG. 4, the non-rocking seat leg connection assembly includes a lower connection plate 8, a limiting buckle 9 and a cylindrical mandrel 10, wherein the cylindrical mandrel 10 is welded to the lower connection plate 8, and the limiting buckle 9 is connected to a folding edge of the lower connection plate 8 through a rivet and are able to rotate around the axis of the rivet.

As shown in FIG. 5, the rocking seat leg connection assembly includes two plate springs 27, a spring fixing plate 28 and a cylindrical mandrel 10, wherein the cylindrical mandrel 10 is welded to the spring fixing plate 28; the spring fixing plate 28 is in a T shape, the upper end of the cylindrical mandrel 10 is fixed to a longitudinal portion of the T shape, and the two plate springs 27 are arranged on the left side and the right side of the spring fixing plate 28 in a bilaterally symmetrical manner; and each plate spring 27 has a front end connected to a horizontal portion of the T shape through a bolt and a rear end fixedly connected to the upper connection plate 7 through a bolt.

Figure 6:
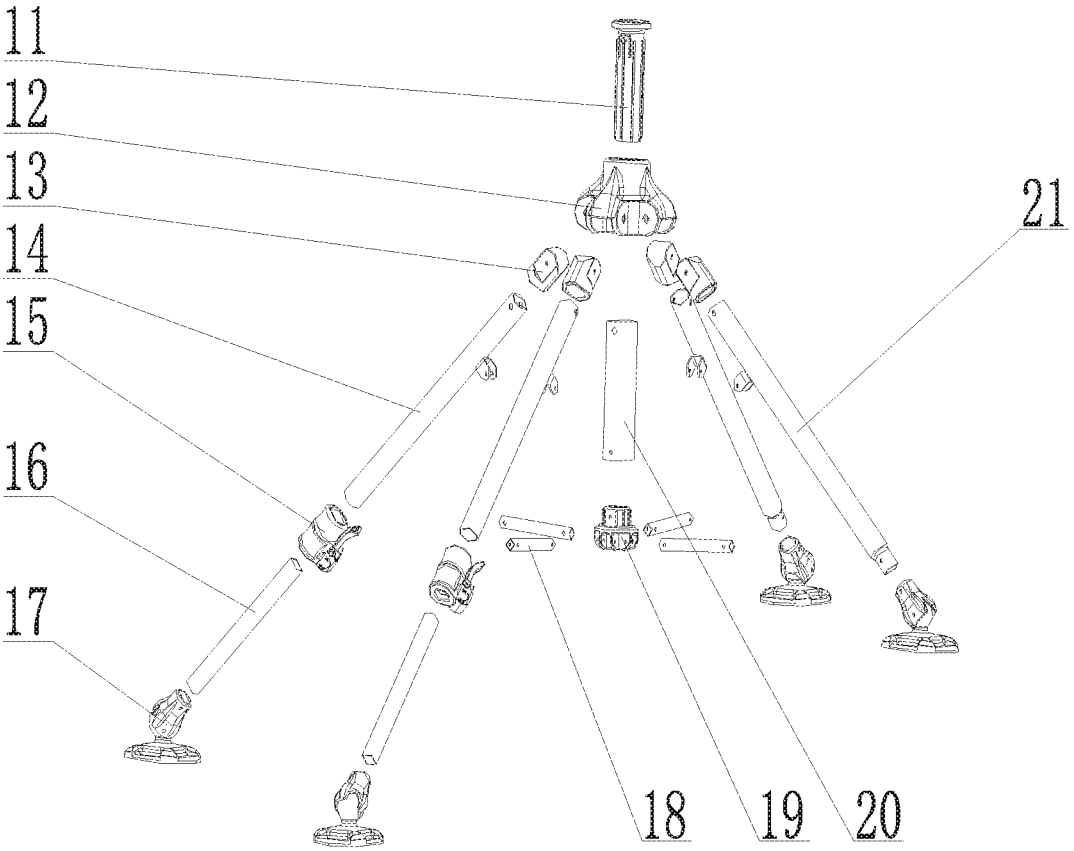
FIG. 6 is an exploded view of a leg tube assembly.

As shown in FIG. 6, the leg tube assembly C includes a bushing 11, an upper leg tube fixing base 12, four upper leg tube connectors 13, two upper stretchable leg tubes 14, two lock mechanisms 15, two lower leg tubes 16, four universal leg pads 17, four tie rods 18, a tie rod base 19, a tie rod base fixing tube 20 and two upper necking leg tubes 21, wherein the bushing 11 is inlaid in the tie rod base fixing tube 20 and is integrally connected with the tie rod base fixing tube 20, and the tie rod base fixing tube 20 is disposed in the upper leg tube fixing base 12 and is able to move upwards or downwards. The bushing 11 is provided with protrusion which is located below an annular flange, and the tie rod base fixing tube 20 has an upper end which is provided with a small hole allowing the protrusion to be cooperatively clamped therein and a lower end which is knocked into the tie rod base 19 and is fixed through a rivet. The upper ends of the two upper stretchable leg tubes 14 and the upper ends of the two upper necking leg tubes 21 are respectively arranged in the upper leg tube connectors 13 in a sleeved manner, are then connected to the upper leg tube fixing base 12 through rivets and are able to rotate around the axis of the corresponding rivets. Limiting pieces used for restraining the upper leg tubes from stretching outwards and rotating are respectively arranged at hinge joints between the upper leg tube fixing base 12 and the upper stretchable leg tubes 14 as well as hinge joints between the upper leg tube fixing base 12 and the upper necking leg tubes 21, wherein necking ends of the two upper necking leg tubes 21 are respectively inserted into holes formed in two universal leg pads 17 and are fixed to the two universal leg pads 17 through rivets, the other ends of the two upper stretchable leg tubes 14 are respectively pressed into two lock mechanisms 15, and the two lower leg tubes 16 riveted with the corresponding universal leg pads 17 are respectively inserted into the two upper stretchable leg tubes 14 through the lock mechanisms 15. One ends of the four tie rods 18 are connected to the tie rod base 19 through rivets, and the other ends of the four tie rods 18 are connected to U-shaped members welded to the two upper stretchable leg tubes 14 and the two upper necking leg tubes 21 through rivets.

Figure 7:
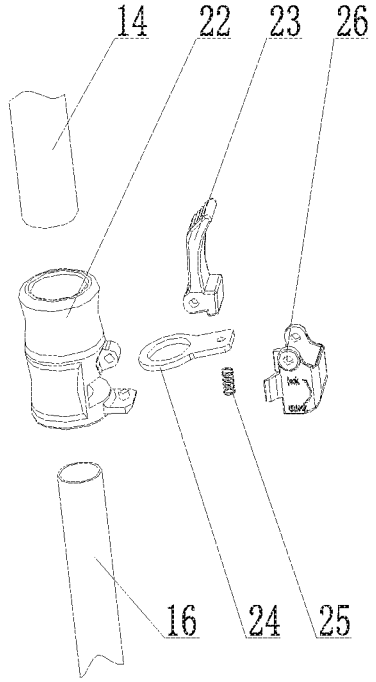
FIG. 7 is an exploded view of a lock mechanism.

As shown in FIG. 7, each lock mechanism includes a lock case 22, a lever 23, a limiting iron ring 24, a compression spring 25 and a protective shell 26. The upper stretchable leg tubes 14 are pressed into the upper ends of the lock cases 22. Openings are formed in lower portions of the lock cases. Limiting grooves are formed in inner walls, opposite to the openings, of the lock cases. The top ends of the openings in the lock cases are higher than the limiting grooves. Ring parts of the limiting iron rings 24 are placed into the lock cases via the openings in the side faces of the lock cases 22. The lower leg tubes 16 are inserted into the lock cases 22 from the lower ends and then penetrate through the ring parts of the limiting iron rings 24 to enter the upper stretchable leg tubes 14, so that the lower leg tubes 16 can be inserted into or pulled out of the upper stretchable leg tubes 14. The compression springs 25 are disposed between handles of the limiting iron rings 24 and the lock cases 22. The levers 23 are disposed above the handles of the limiting iron rings 24 and are covered with the protective shells 26. The lever 23 and are protective shells 26 are connected to the lock cases 22 through rivets.

The working process of the swivel chair of the invention is as follows: the lower connection plate 8 of the non-rocking seat leg connection assembly is inserted into the sliding grooves of the upper connection plate 7 of the chair frame assembly A and is then clamped on the folding edge of the upper connection plate 7 by rotating the limiting buckle 9 on the folding edge of the lower connection plate 8, so that the lower connection plate 8 is prevented from disengaging from the sliding grooves of the upper connection plate 7; the chair frame assembly A and the seat leg connection assembly B are integrally connected; and after the chair frame assembly A and the seat leg connection assembly B are integrally connected, the cylindrical mandrel 10 in the seat leg connection assembly B is inserted into the bushing 11 of the leg tube assembly C. The four universal leg pads 17 are settled on the ground in parallel after the leg tube assembly C is unfolded, so that the leg tube assembly C is kept stationary relative to the ground in the absence of an external force. In this way, the cylindrical mandrel 10 can freely rotate in the bushing 11, and then the chair frame assembly A and the seat leg connection assembly B which are integrally connected are driven to rotate synchronously.

The rear ends (suspension ends) of the two plate springs 27 of the rocking seat leg connection assembly are connected to the upper connection plate 7 of the chair frame assembly A through bolts, so that the chair frame assembly A and the seat leg connection assembly B are integrally connected. After the chair frame assembly A and the seat leg connection assembly B are integrally connected, the cylindrical mandrel 10 in the seat leg connection assembly B is inserted into the bushing 11 of the leg tube assembly C. The four universal leg pads 17 are settled on the ground in parallel after the leg tube assembly C is unfolded, so that the leg tube assembly C is kept stationary relative to the ground in the absence of an external force. In this way, the cylindrical mandrel 10 can freely rotate in the bushing 11, and then the chair frame assembly A and the seat leg connection assembly B which are integrally connected are driven to rotate synchronously.

Or, the back tube 4 can be pressed backwards to drive the chair frame assembly A and the plate springs 27, connected with the chair frame assembly A through bolts, to move backwards synchronously, while the spring fixing plate 28 connected with the other ends of the plate springs 27 through bolts, and the cylindrical mandrel 10 are inserted into the bushing 11 of the non-rocking leg tube assembly C, so that the plate springs 27 deform and bend. When the back tube 4 is released, the plate springs in the bent state restore to become straight under the effect of self stress.

Figure 9:
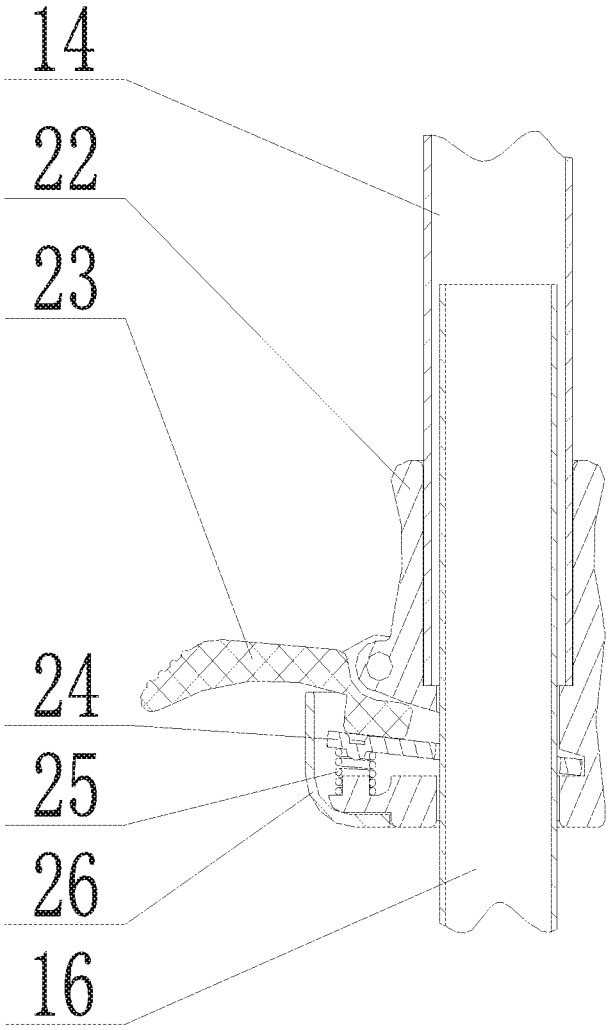
FIG. 9 is a view of the lock mechanism in an unlocked state.

The working principle of the lock mechanisms is as follows:

As shown in FIG. 9, when the lock mechanisms are to be unlocked, the lower leg tubes 16 penetrate through the ring parts, which are located in the openings of the lock cases 22 and are clamped in the limiting grooves in the inner walls of the lock cases, of the limiting iron rings 24, so that when the levers 23 are rotated downwards, the handles of the limiting iron rings 24 are pressed downward with the contact points between the ring parts, located in the openings of the lock cases 22, of the limiting iron rings 24 and the inner walls of the lock cases 22 as center till the axes of the limiting iron rings 24 are perpendicular to the axes of the lower leg tubes 16, and at this moment, the lower leg tubes 16 having the outer diameter slightly smaller than the inner diameter of the ring parts of the limiting iron rings 24 penetrate through the limiting iron rings 24 and the lock cases 22 to enter the upper stretchable leg tubes 14, and thus, the length of the leg tubes 14 is adjusted.

Figure 8:
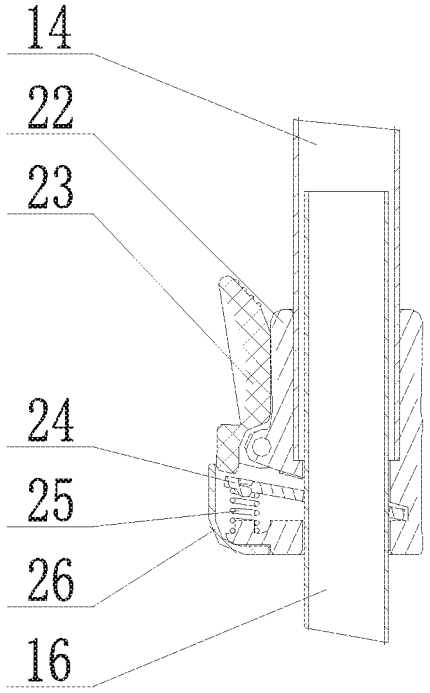
FIG. 8 is a view of the lock mechanism in a locked state.

As shown in FIG. 8 when the lock mechanisms are to be locked, the levers 23 are rotated upwards, and at this moment, the handles of the limiting iron rings 24 in the horizontal state tilt upwards, under the effect of the compression springs, with the contact points between the ring parts, located in the openings in the inner walls of the lock cases 22, of the limiting iron rings 24 and the inner walls of the lock cases 22 as enters till the inner edges of the ring parts of the limiting iron rings 24 make contact with the tube walls of the lower leg tubes 16. The levers 23 continue to be rotated upwards to extreme position to separate the handles of the limiting iron rings 24 from the levers 23. When the lower leg tubes 16 are about to move upwards retract into the upper stretchable leg tubes 14, the limiting iron rings 24 clamping the lower leg tubes 16 move into the upper stretchable leg tubes 14 along with the lower leg tubes 16. The ring parts of the limiting iron rings 24 are limited in the inner walls of the lock cases 22 and cannot continue to move inwards anymore, while the handles continue to tilt upwards under the combined action of the compression springs and an inward moving force from the lower leg tubes 16, so that the lower leg tubes 16 are clamped more and more firmly and finally cannot move anymore, and in this way, a locking function is fulfilled.

The folding process of the swivel chair of the invention is as follows:

In order to reduce the packaging size to ensure the portability of the swivel chair, the swivel chair provided with the length-adjustable leg tubes is divided into three parts: the chair frame assembly A, the seat leg connection assembly B and the leg tube assembly C, wherein when the chair frame assembly A is folded, the back tube 4, together with the left and right turning bases 5, 3 at the two ends of the back tube 4 and the turning base reinforcing pieces 2, is rotated inwards till the back tube 4 is attached to the circular tube of the seat frame 6.

When a non-rocking seat leg connection assembly serving as the seat leg connection assembly B is folded, the limiting buckle 9 riveted on the folding edge of the lower connection plate 8 is clockwise rotated to release the lower connection plate 8, restrained by the upper connection plate 7 of the chair frame assembly A, of the seat leg connection assembly B, then the lower connection plate 8 is pulled out of the sliding grooves of the upper connection plate 7, and accordingly, the chair frame assembly A is separated from the seat leg connection assembly B. Afterwards, the cylindrical mandrel 10 welded to the lower connection plate 8 is pulled out of the bushing 11 of the leg tube assembly C to separate the leg tube assembly C from the seat leg connection assembly B.

When a rocking seat leg connection assembly serving as the seat leg connection assembly B is folded, the bolts used for connecting the plate springs 27 and the upper connection plate 7 of the chair frame assembly A are unscrewed first, so that the chair frame assembly A is separated from the seat leg connection assembly B. Afterwards, the cylindrical mandrel 10 welded to the lower connection plate 8 is pulled out of the bushing 11 of the leg tube assembly C, so that the leg tube assembly C is separated from the seat leg connection assembly B.

When the leg tube assembly C is folded, the levers 23 of the lock mechanisms 15 are downwards pulled to extreme positions first till the axes of the limiting iron rings 24 are perpendicular to the axes of the lower leg tubes 16; then the lower leg tubes 16 are pushed upwards to retract into the upper leg tubes 14 till the universal leg pads 17 make contact with the lock mechanisms 15; and afterwards, the tie rod base 19 is pushed upwards to drive the tie rods 18 retract inwards, and at this moment, the tie rods 18 pull the upper stretchable leg tubes 14 connected with the other ends of the tie rods 18 to retract inwards synchronously, so that the leg tube assembly is folded. The leg tube assembly C can be unfolded by performing these operations reversely.

Usage of the invention: when the swivel chair is used for outdoor fishing, the lower leg tubes retracting inwards are pulled out according to the ground condition, and then the lengths of the lower leg tubes are independently adjusted to keep the chair frame level; when the swivel chair is used indoors, the two lower leg tubes 16 can be rotated in front of the chair and are then stretched to make the whole chair become lower gradually from front to back, so that people can half lie on the chair, and in this case, the swivel chair is transformed into a rocking chair by being used in cooperation with the rocking seat leg connection assembly.

What is claimed is:

1. A swivel chair provided with length-adjustable leg tubes, comprising: a chair frame assembly, a seat leg connection assembly, and a leg tube assembly rotatably connected with the chair frame assembly through the seat leg connection assembly, wherein the chair frame assembly includes a chair cloth, two turning bases, two turning base reinforcing pieces, a back tube, a seat frame and an upper connection plate, the back tube is perpendicular to the seat frame, a left end and a right end of the back tube can be turned forwards by 90° respectively through the two turning bases so as to be hinged to the seat frame, the upper connection plate is fixedly mounted at a bottom of the seat frame, the two turning base reinforcing pieces are respectively attached to outer sides of the two turning bases and are connected with the back tube and the seat frame through rivets, together with the turning bases, and the back tube and the seat frame are sleeved with the chair cloth;

the leg tube assembly includes a bushing used for mounting the seat leg connection assembly, an upper leg tube fixing base, four upper leg tube connectors, two upper stretchable leg tubes, two lock mechanism, two lower leg tubes, four universal leg pads, four tie rods, a tie rod base, a tie rod base fixing tube and two upper necking leg tubes, wherein an annular flange is arranged at an upper end of the bushing and has an outer diameter greater than an inner diameter of the upper leg tube fixing base, the bushing is inlaid in the tie rod base fixing tube from top to bottom and is integrally connected with the tie rod base fixing tube, the tie rod base fixing tube is disposed in the upper leg tube fixing base and is able to move upwards or downwards, and a lower end of the tie rod base fixing tube is fixedly mounted on an upper portion of the tie rod base; the two upper stretchable leg tube are arranged adjacently, the two upper necking leg tubes are arranged adjacently, the two upper stretchable leg tubes are bilaterally symmetrical with the two upper necking leg tubes, lower ends of the upper necking leg tubes are necking ends, upper ends of the two upper stretchable leg tubes and upper ends of the two upper necking leg tubes are respectively arranged in the four upper leg tube connectors in a sleeved manner and are rotatably connected to the upper leg tube fixing base through rivets, the necking ends of the two upper necking leg tubes are respectively connected with two said universal leg pads, lower ends of the two lower leg tubes are connected with the other two universal leg pads, upper ends of the two lower leg tubes stretch into lower ends of the two upper stretchable leg tubes and stretch upwards or retract downwards through the two lock mechanisms, the four tie rods each having one end hinged to a lower portion of the tie rod base and one ends respectively hinged to upper portions of the two upper stretchable leg tubes and upper portions of the two upper necking leg tubes;

the back tube can be turned forwards through the turning bases so as to be folded, the two upper stretchable leg tubes and the two upper necking leg tubes can be drawn inwards, and the lower leg tubes can stretch upwards or retract downwards in the upper stretchable leg tubes by locking or unlocking the lock mechanisms.

2. The swivel chair provided with length-adjustable leg tubes according to claim 1, wherein each said lock mechanism includes a lock case, a lever, a limiting iron ring, a compression spring and a protective shell, an opening is formed in a side face of a lower portion of the lock case, a limiting groove is formed in an inner wall, opposite to the opening, of the lock case, a top end of the opening in the lock case is higher than the limiting groove, a ring part of the limiting iron ring is located in the opening of the lock case and is clamped in the limiting groove, the compression spring is located below the limiting iron ring and has an upper end connected with a handle of the limiting iron ring and a lower end connected with the lock case, the protective shell is located outside the compression spring, and the lever is located above the limiting iron ring and is hinged to the protective shell and the lock case; the lower ends of the upper stretchable leg tubes stretch into upper portions of the lock cases, upper ends of the lower leg tubes sequentially penetrate through lower portions of the lock cases and the ring parts of the limiting iron rings from bottom to top to stretch into the upper stretchable leg tubes, and the ring parts of the limiting iron rings have an inner diameter greater than an outer diameter of the lower leg tubes;

lower ends of the levers are of an eccentric structure; and when the levers are rotated downwards, the lower ends of the levers downwards press the handles of the limiting iron rings to realize unlocking, and then the lower leg tubes can stretch upwards or retract downwards.

3. The swivel chair provided with length-adjustable leg tubes according to claim 2, wherein the seat leg connection assembly is a non-rocking seat leg connection assembly which includes a lower connection plate, a limiting buckle and a cylindrical mandrel, the cylindrical mandrel has an upper end fixed to a bottom of the lower connection plate and is rotatably assembled on the bushing, a folding edge capable of being folded upward is arranged on a front side of the lower connection plate, sliding grooves are formed in a left side and a right side of the upper connection plate, a folding edge capable of being folded upwards is arranged in a middle of a front side of the upper connection plate, the limiting buckle is located on a right side of the upper connection plate and is hinged to the folding edge of the lower connection plate, the lower connection plate is inserted into the sliding grooves in the left side and the right side of the upper connection plate, the limiting buckle is rotated to be clamped on the folding edge of the upper connection plate, and then the upper connection plate is prevented from disengaging from the sliding grooves, so that locking or unlocking is realized.

4. The swivel chair provided with length-adjustable leg tubes according to claim 2, wherein the seat leg connection assembly is a rocking seat leg connection assembly which includes two plate springs, a spring fixing plate and a cylindrical mandrel, the spring fixing plate is in a T shape, an upper end of the cylindrical mandrel is fixed to a longitudinal portion of the T shape, the two plate springs are arranged on a left side and a right side of the spring fixing plate in a bilaterally symmetrical manner, and each said plate spring has a front end connected to a horizontal portion of the T shape and a rear end fixed to the upper connection plate through a bolt.

5. The swivel chair provided with length-adjustable leg tubes according to claim 2, wherein the seat frame includes a U-shaped circular tube which is open forwards and a plurality of U-shaped square tubes which are open upwards, each said U-shaped square tube have two ends respectively fixed to a left side and a right side of the U-shaped circular tube, bottoms of the U-shaped square tubes are located on a same plane, and the upper connection plate is welded to the bottoms of the U-shaped square tubes.

6. The swivel chair provided with length-adjustable leg tubes according to claim 1, wherein the seat leg connection assembly is a non-rocking seat leg connection assembly which includes a lower connection plate, a limiting buckle and a cylindrical mandrel, the cylindrical mandrel has an upper end fixed to a bottom of the lower connection plate and is rotatably assembled on the bushing, a folding edge capable of being folded upward is arranged on a front side of the lower connection plate, sliding grooves are formed in a left side and a right side of the upper connection plate, a folding edge capable of being folded upwards is arranged in a middle of a front side of the upper connection plate, the limiting buckle is located on a right side of the upper connection plate and is hinged to the folding edge of the lower connection plate, the lower connection plate is inserted into the sliding grooves in the left side and the right side of the upper connection plate, the limiting buckle is rotated to be clamped on the folding edge of the upper connection plate, and then the upper connection plate is prevented from disengaging from the sliding grooves, so that locking or unlocking is realized.

7. The swivel chair provided with length-adjustable leg tubes according to claim 1, wherein the seat leg connection assembly is a rocking seat leg connection assembly which includes two plate springs, a spring fixing plate and a cylindrical mandrel, the spring fixing plate is in a T shape, an upper end of the cylindrical mandrel is fixed to a longitudinal portion of the T shape, the two plate springs are arranged on a left side and a right side of the spring fixing plate in a bilaterally symmetrical manner, and each said plate spring has a front end connected to a horizontal portion of the T shape and a rear end fixed to the upper connection plate through a bolt.

8. The swivel chair provided with length-adjustable leg tubes according to claim 1, wherein the seat frame includes a U-shaped circular tube which is open forwards and a plurality of U-shaped square tubes which are open upwards, each said U-shaped square tube have two ends respectively fixed to a left side and a right side of the U-shaped circular tube, bottoms of the U-shaped square tubes are located on a same plane, and the upper connection plate is welded to the bottoms of the U-shaped square tubes.

* * * * *